United States Patent [19]

Kodet

[11] Patent Number: 4,606,575

[45] Date of Patent: Aug. 19, 1986

[54] LOCK RELEASE FOR FOLDING TABLE

[75] Inventor: Reuben P. Kodet, Kiel, Wis.

[73] Assignee: Hamilton Industries, Two Rivers, Wis.

[21] Appl. No.: 582,178

[22] Filed: Feb. 21, 1984

[51] Int. Cl.[4] ..... A47B 85/04

[52] U.S. Cl. ..... 297/124; 108/99; 108/133

[58] Field of Search ..... 297/124, 16, 151, 149, 297/153; 108/133, 36, 99

[56] References Cited

U.S. PATENT DOCUMENTS

| | | | |
|---|---|---|---|
| 89,045 | 4/1869 | Hilts . | |
| 188,414 | 3/1877 | Rohde . | |
| 199,150 | 1/1878 | Flather | 108/80 |
| 245,926 | 8/1881 | Ahrens . | |
| 332,125 | 12/1885 | Welker . | |
| 334,239 | 1/1886 | Kline . | |
| 339,427 | 4/1886 | Kade . | |
| 340,519 | 4/1886 | Pleukharp . | |
| 359,322 | 3/1887 | Kaufhold . | |
| 359,432 | 3/1887 | Colvin . | |
| 484,723 | 10/1892 | Phillips | 108/80 |
| 827,673 | 7/1906 | Swart | 108/133 |
| 1,937,886 | 12/1933 | Grose | 297/124 |
| 2,115,860 | 5/1938 | Kroll et al. | 297/151 |
| 2,561,703 | 7/1951 | Koenig | 297/124 X |
| 2,675,859 | 4/1954 | Abler | 297/124 |
| 2,723,890 | 11/1955 | Erickson | 311/104 |
| 2,740,680 | 4/1956 | Hamilton | 311/65 |
| 2,764,460 | 9/1956 | Nelson | 311/92 |
| 2,949,154 | 8/1960 | Homme | 155/124 |
| 2,992,043 | 7/1961 | Nelson | 297/159 |
| 3,028,197 | 4/1962 | Wilson | 297/124 |
| 3,061,369 | 10/1962 | Haunost | 297/124 |
| 3,101,062 | 8/1963 | Kanzelberger | 108/37 |
| 3,101,064 | 8/1963 | Kanzelberger | 108/113 |
| 3,140,674 | 7/1964 | Cisler | 108/113 |
| 3,191,991 | 6/1965 | Anderson | 297/159 |
| 3,212,463 | 10/1965 | Anderson | 108/113 |
| 3,381,998 | 5/1968 | Cheshier et al. | 297/124 |
| 3,416,468 | 12/1968 | Peterson | 108/131 |

FOREIGN PATENT DOCUMENTS

| | | | |
|---|---|---|---|
| 232042 | 1/1960 | Australia | 297/124 |

*Primary Examiner*—Francis K. Zugel

*Attorney, Agent, or Firm*—Tilton, Fallon, Lungmus

[57] ABSTRACT

A lock release for folding tables and shelves in which the locking mechanism to prevent accidental pivoting of the top from a horizontal unfolded position to a generally vertical folded position includes a pivotal link member with guiding edges or surfaces for slidably directing a connector element along the link as the top is folded and unfolded. Most advantageously, the lock is double-acting—that is, two distinct manipulations are required to release the locking mechanism. In a preferred embodiment, the link member has an L-shaped guide slot with an elongated main portion and a relatively short end portion. When the top is horizontal, the connector element is located within the slot's end portion and, to permit the connector element to enter the elongated main portion of the slot, the link member must be shifted about its pivotal axis by the user. In addition, to release the connector element for sliding movement along the slot's main portion, the user must also shift a spring-loaded stop plate laterally out of the path of movement of the connector element. The stop plate is hingedly connected to the link member and includes a handle extension so that by gripping and shifting the extension a user may perform both unlocking actions at the same time. In another embodiment the link member is unslotted, but again, movement of the connector element along the link member is normally obstructed by a pivotal spring-loaded stop plate which performs a releasable locking function.

11 Claims, 11 Drawing Figures

LOCK RELEASE FOR FOLDING TABLE

BACKGROUND AND SUMMARY

Co-owned U.S. Pat. No. 3,416,468 discloses a folding table construction having leg braces 88, 89 that slide along a slotted center support 71 as the legs are extended and retracted. Slidable latches 103 have slanted surfaces which engage the rivets of the braces to hold the rivets within the end portions of the slots when the legs are fully extended.

Other patents disclose tables having folding top portions with braces that slide along slotted guide members and in which spring elements are provided to hold the braces in latched or locked condition when the top sections are in fully-extended horizontal positions. Reference may be made to U.S. Pat. Nos. 2,704,680, 245,926, and 188,414. In each case, the spring exerts a force tending to urge the brace into its seated or locked position so that if the spring is overcome by a force applied to unseat the brace, the hinged top section will be free to swing downwardly into its folded position. The spring therefore performs a holding function in what is essentially a single action latch release mechanism. By applying sufficient force in one direction, each such latching mechanism may be released.

Other types of folding tables are known where the pivots for the tops are located so that such tops tend to be stable when they are horizontally disposed even when the latches are released. To fold such a top into a generally vertical condition for storage (or for use of the top as a backrest), a lifting force is therefore normally required to be applied to the top. In addition, the single-action latch must be released. It has been found, however, that if the stability of the top in its horizontal condition is altered by a substantial downward force applied to one edge of the top, so that such downward force along that edge has a similar effect as a lifting force applied to the opposite edge, and if at the same time the single-action latch is unintentionally (or intentionally) released, the table top will pivot into its vertical position. Providing such a latch with a spring element as disclosed in the aforementioned patents would not eliminate the problem because a force applied to the latch sufficient to overcome the spring would still release the top for automatic folding if the top were loaded unequally as described.

Therefore, an object of this invention is to provide a double-action lock release which insures against unintended pivoting of the top of a table from its horizontal operative position into a generally vertical or collapsed position. This object is achieved by providing such a table with a link member which, in a preferred embodiment of the invention, has a L-shaped guide slot that slidably receives the connecting element of another portion of the table. A stop plate overlies the portion of the guide slot and is movably mounted upon the link member for movement between a first position that obstructs sliding movement of the connecting element along the slot and a second position displaced from the slot to permit such sliding movement of the connecting element. Such movement of the stop member between its first and second positions is transverse to the direction of movement of the connecting element along the slot; hence, to release the table for folding action of the top, a user must apply two forces at generally right angles to each other. Since the possibility that both forces might be applied accidentally are negligible, and since two distinct steps are required to execute release of the double-action lock, a user is well protected against sudden folding of the table that might be occasioned by vibration, accidental bumping of the latch mechanism, or deliberate action by a prankster.

The stop plate is hingedly connected to the link member and is urged by a spring into a position that normally obstructs sliding movement of the connecting element along the guide slot. In such a position, the stop plate, or at least a portion of that plate, extends along a plane that is generally parallel with the slotted link member. The stop plate includes a handle portion or extension that may be gripped by a user to pivot the stop plate away from the link member to allow passage of the connecting element along the length of the slot. The handle portion is arranged so that it may be gripped by a user to perform the dual functions of first pivoting the link member to shift the connecting element out of the short end portion of the L-shaped slot and into alignment with the elongated main portion of that slot and, second, to swing the stop plate out of the path of the connecting element as it slides along the main portion of the slot.

Although the stop plate performs a secondary locking function in the double-acting lock mechanism described, it would perform the only locking function if the short end portion of the slot were omitted. Furthermore, the connector element need not necessarily slide within a slot extending along the guide link; in a second embodiment, the connector element externally engages the elongated link member and its sliding movement along that member is normally restrained by a spring-loaded stop plate pivotally supported in a manner similar to that already described.

Other advantages, objects, and features of the invention will become apparent from the specification and drawings.

DRAWINGS

Figure 10:
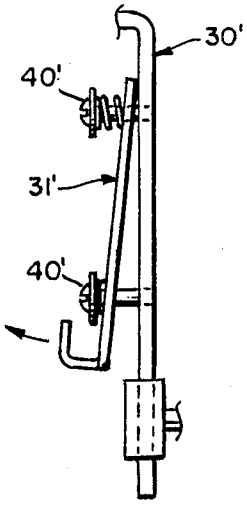
FIG. 10 is a fragmentary view similar to FIG. 7 but showing the top member in its releasing position.
Figure 11:
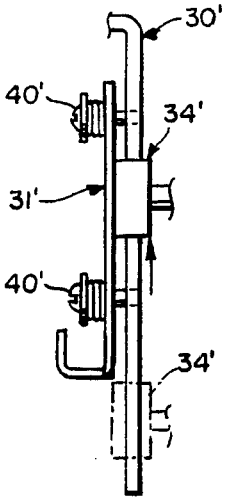

FIG. 11 an elevational view similar to FIG. 10 but showing the position of the connecting element when the top has been pivotted into its folded position.

DETAILED DESCRIPTION

Figure 1:
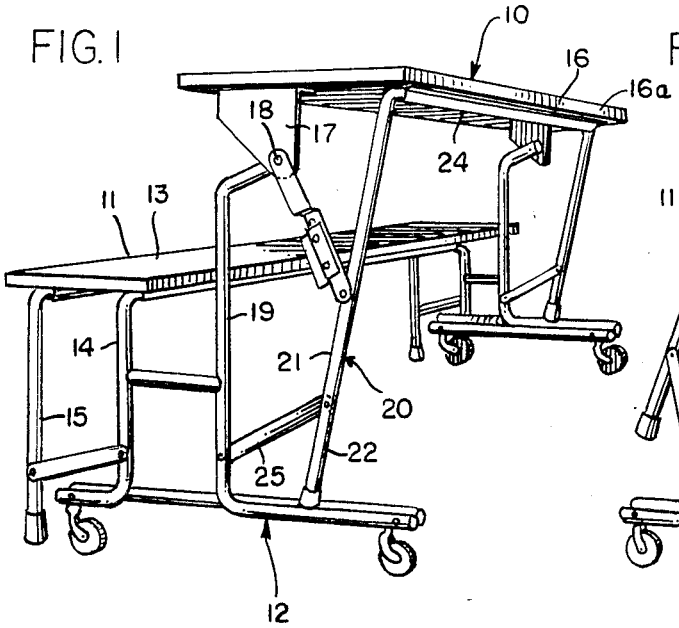
FIG. 1 is a perspective view of a foldable bench and table combination equipped with the double-action lock release of this invention.
Figure 2:
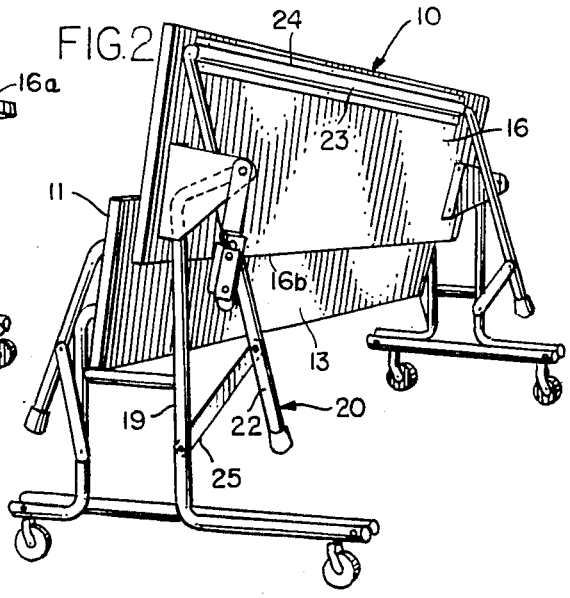
FIG. 2 is a perspective view of the bench and table combination in its collapsed or folded condition.

Referring to the drawings, the numeral 10 generally designates a folding table equipped with an attached bench 11, the combination being particularly suitable for use in schools and other institutions. The bench is mounted upon the same frame 12 that supports the table and, in the illustration given, includes a seat panel 13 hingedly mounted upon frame member 14 and equipped with a floor-engaging leg assembly 15. The bench is shown in its normal operative position in FIG. 1 and in an upwardly folded or collapsed position in FIG. 2; however, it is to be understood that for purposes of describing this invention the bench need not be foldable and need not even be part of the table assembly 10.

Table 10 includes a generally rectangular top 16 having longitudinal and parallel side edges 16*a* and 16*b*. Support plates or arms 17 extend downwardly from opposite ends of the top 16 and are pivotally connected by pivot pins or elements 18 to the upper ends of upstanding frame members 19. Such pivotal mounting permits the top to be swung about a horizontal pivot line between the horizontal unfolded position shown in FIG. 1 and a generally vertical folded position depicted in FIG. 2. The vertical position of top 16 is useful not only in achieving greater compaction for storage purposes but also allowing the top to function as a backrest for the bench 11. Such dual functions of the top (for use both as a support surface and as a backrest) are facilitated by locating the pivots 18 at points spaced well below the surface of the top (when it is in its horizontal position of FIG. 1) and at intermediate points between the longitudinal front and rear edges 16*a* and 16*b*, respectively.

A folding leg assembly 20 is connected to the table top 16 to brace that top in its horizontal position. The leg assembly includes a tubular frame member 21 of inverted U-shaped configuration, the tubular member including leg portions 22 and a horizontal intermediate portion 23 hingedly connected by bracket 24 to the underside of top 16. Links 25 are connected to the lower ends of the legs 22 and frame members 19 for guiding operation of the leg assembly as the top is shifted between its folded and unfolded positions.

All of the structure described above is known in the art. It is also known to provide a slotted link member 30 between leg assembly 20 and one of the pivots 18. The improvements of this embodiment lie, first, in providing such a link member with a stop plate 31 of the structure and function hereinafter described, and second, in providing such elements as part of a folding table or shelf combination to achieve a double-action lock release.

The link member 30 takes the form of a flat, elongated bar having offset planar upper and lower portions 30*a* and 30*b*, respectively. The upper portion 30*a* has an opening 32 at its free end for receiving pivot element 18. The elongated lower portion is provided with an L-shaped slot 33 that has an elongated main portion or leg 33*a* extending generally longitudinally with respect to the link member and a relatively short end portion or leg 33*b* located at the end of the link member opposite from its pivot opening 32. A connecting element 34 in the form of a bolt having an enlarged head 34*a* is secured to leg portion 22 of leg assembly 20 and extends through slot 33, the inwardly-facing edges of the link member that define the slot serving as guide means for directing movement of element 34.

Figure 3:
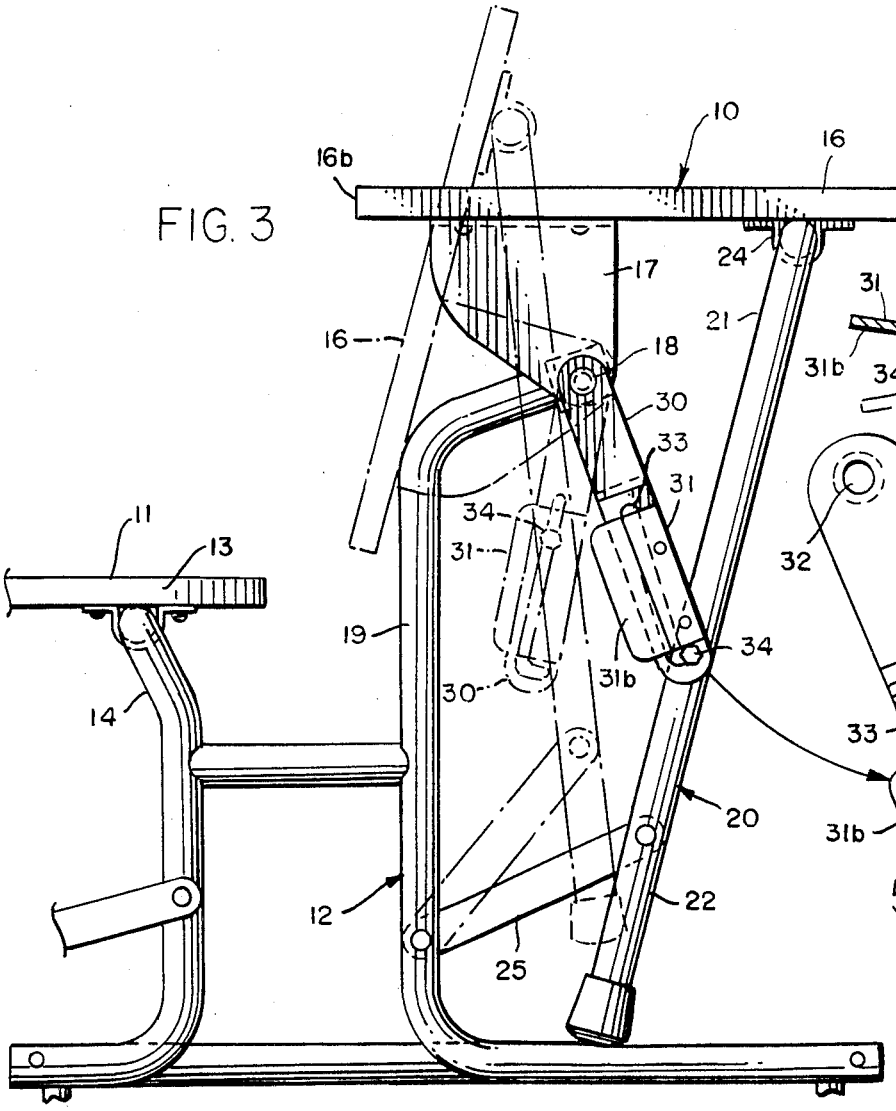
FIG. 3 is a side elevational view of the folding table and bench with the table top being shown in its horizontal operative position in solid lines and in its folded condition in broken lines.
Figure 4:
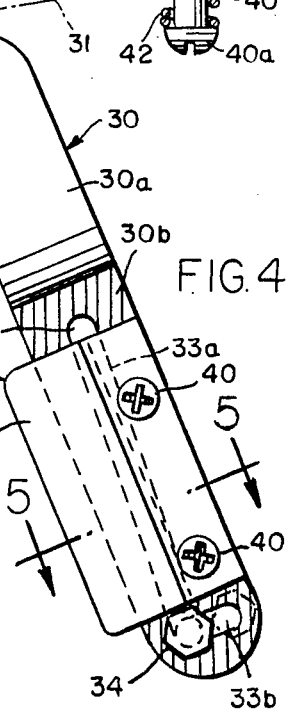
FIG. 4 is an enlarged elevational view of the link member and stop plate construction after the first stage of the two-stage lock release has taken place.

When the table top 16 is in its unfolded horizontal position, connecting element 34 is located at the lower end of the link member and extends through the short leg or end portion 33*b* of the slot 33. It will be noted from FIG. 3 that with the table unfolded and the top in its horizontal position, the link member 30 angles downwardly and forwardly from its pivot 18 so that, under the influence of gravity, link member 30 tends to pivot downwardly (clockwise as shown in FIG. 3) to seat connecting element 34 at the extreme (forward) end of the slot. To allow the top to be swung into its folded position (as depicted in broken lines in FIG. 3), the link must be pivoted forwardly to bring connecting element 34 into alignment with the elongated main portion 33*a* of the slot (FIG. 4). Consequently, when the connecting element is located at the extreme end of the slot's lower leg portion 33*b*, link member 30 locks the top 16 in its horizontal or unfolded position. As a first step in releasing the lock, the link member 30 must be lifted or pivoted forwardly to shift connecting element 34 into an area of the slot where the two leg portions 33*a* and 33*b* join each other (FIG. 4).

Figure 5:
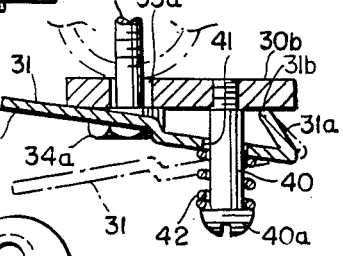
FIG. 5 is an enlarged sectional view taken along line 5—5 of FIG. 4 and showing in broken lines the outward pivoting of the stop plate that constitutes the second stage of the lock release.

The stop plate 31 is mounted upon the slotted lower portion 30*b* of the link member for movement about a pivot axis 31*b* extending along the plane of the link member between a first position, shown in solid lines in FIG. 5, and a second position (broken lines). In the illustration given, the plate is connected to the link member by a pair of mounting screws 40 that project through enlarged openings 41 in the plate. One edge portion 31*a* (the forward edge portion) of the plate is turned inwardly to engage the link member 30 and provide the hinge line or pivot axis 31*b* for rocking movement of the stop plate between its first and second positions. Spring means are provided for urging the plate into its first (locking) position; in the form illustrated, such spring means conveniently takes the form of compression coil springs 42 extending along the shafts of screws 40 between stop plate 31 and the enlarged heads 40*a* of those screws (FIG. 5).

The stop plate 31 also includes a flange portion 31*b* that projects rearwardly beyond the limits of link member 30 to provide an enlarged handle for manually shifting the stop plate into its second or unlocking position illustrated in broken lines in FIG. 5. The handle has an additional function—it may be gripped by a user to swing the link member 30 forwardly to carry out the first unlocking action previously described.

The stop member extends along substantially the full length of the main leg portion of the slot 33 and, when in its normal first position or locking position, has its flange or handle portion 31*b* in direct contact with the link member 30. In that position, the stop member 31 blocks upward travel of connecting element 34 when that connecting element is located at the extreme lower end of the slot's main portion 33*a* (FIG. 4). Therefore, to fully release the lock to permit swinging movement of the top into its folded position, a user must pivot stop plate 31 outwardly away from slot 33, thereby allowing the connecting element 34 to travel upwardly along the main portion of the slot.

Two unlocking actions are therefore necessary in order to release the top for movement into its folded position: link member 30 must be swung forwardly about its pivot 18 to shift connecting element 34 into a position in alignment with the main portion 33*a* of the slot, and the stop member 31 must be pivoted outwardly away from the slotted portion of the link member to permit the connecting element 34 to travel upwardly along the length of the slot. Although both unlocking actions may be performed by gripping the handle portion 31*b* of the stop member and either simultaneously or sequentially pivoting the link member forwardly and the stop member outwardly, the possibility of the double unlocking actions occurring accidentially, or even deliberately by a prankster, is extremely remote because the two actions occur about different pivot axes at right angles to each other.

While the stop plate 31 performs a secondary locking function in the double-acting lock mechanism described, such locking function would constitute the only locking function if the short end portion 33*b* of the guide slot 33 were eliminated. Whether or not such portion were eliminated, the stop plate 31 would nevertheless coact with the link member 30 and connecting element 34 to obstruct movement of the connecting element along portion 33*a* of the slot and thereby perform a releasable locking function.

In the embodiment of FIGS. 3–5, the inwardly-facing edges or surfaces of guide slot 33 constitute the means for directing movement of connecting element 34 with respect to the link member 30. In the embodiment of FIGS. 6–11, link member 30' is unslotted and connecting element 34' is channel-shaped when viewed in cross-section (FIG. 8). Channel 60 slidably receives the lower portion 30*b'* of link member 30' with the parallel edges or surfaces of that portion serving as guide means for directing movement of the connecting element 34' as the table top is shifted between its folded and unfolded positions. A pin 62 pivotally secures the connecting element 34' to frame member 21 and, as shown in FIG. 8, a retainer in the form of nut 63 is threaded onto the end of the pin to maintain the parts in connected relation.

Stop plate 31' is mounted upon the lower portion 30*b'* of the link member for movement between a first or locking position and a second or releasing position. In the illustration given, the plate is connected to the link member by a pair of mounting screws 40' that project through enlarged openings 41' in the plate. As shown most clearly in FIG. 9, the lower end portion of the stop plate is provided with a handle 64 that projects outwardly and then upwardly to facilitate pivotal movement of the stop plate between the normal locking position depicted in FIG. 7 and the unlocking position shown in FIG. 10. Spring means are provided for urging the plate into its locking position; as in the previous embodiment, such spring means conveniently takes the form of compression coil springs 42' extending along the shafts of screws 40' between stop plate 31' and the enlarged heads of those screws.

Figure 6:
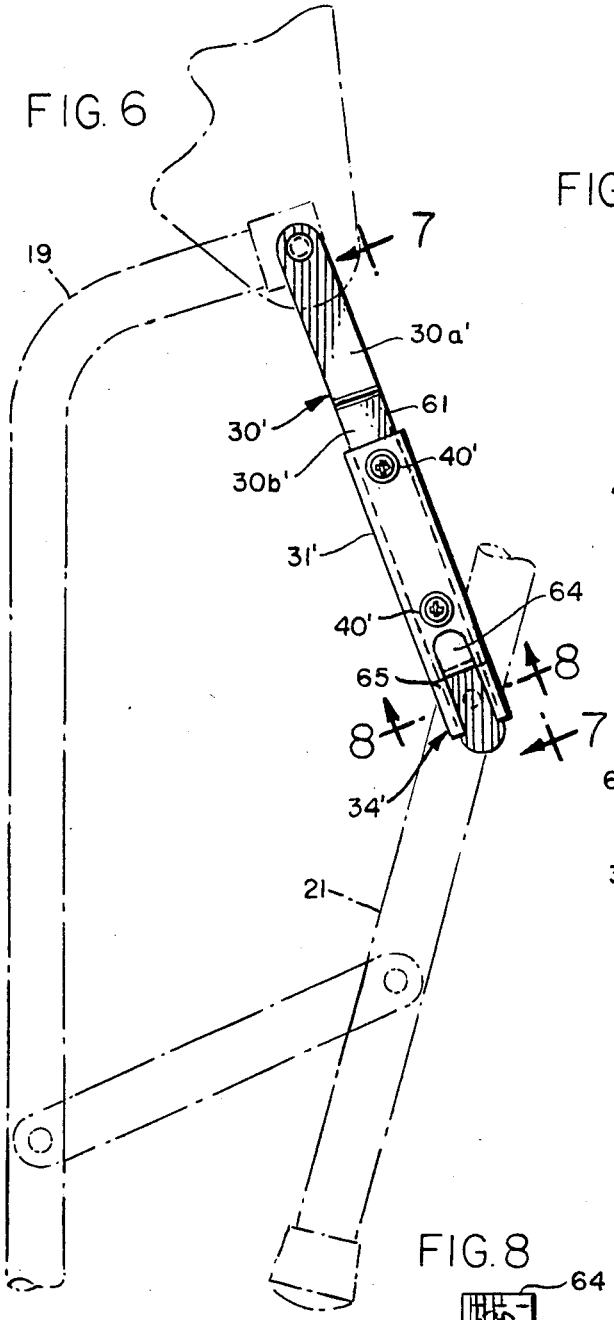
FIG. 6 is a side elevational view showing a portion of a folding table structure with a link lock assembly constituting a second embodiment of this invention.
Figure 7:
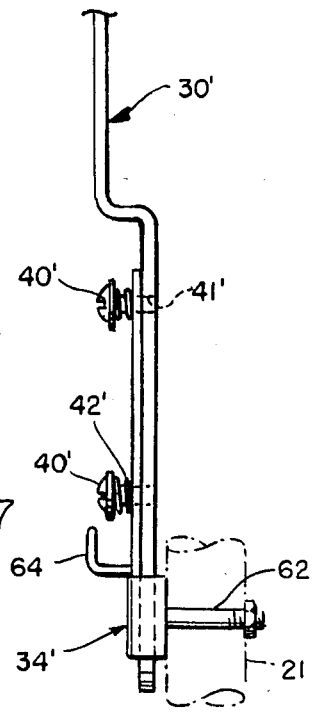
FIG. 7 is a longitudinal view of the link lock assembly taken along line 7—7 of FIG. 6.
Figure 9:
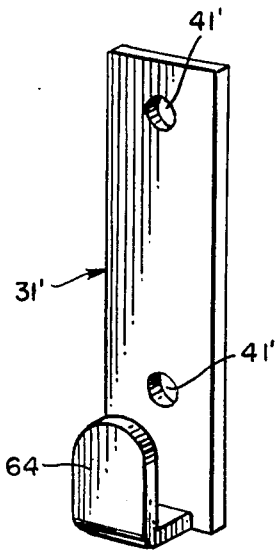
FIG. 9 is a perspective view of the pivotal stop member of the second embodiment.
Figure 8:
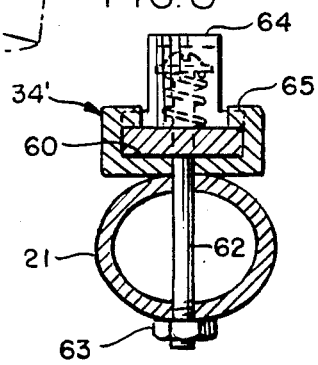
FIG. 8 is an enlarged cross sectional view taken along line 8—8 of FIG. 6.

FIGS. 6 and 7 show the mechanism in its normal locked position with the lower end of stop plate 31 engaging or engagable with the inwardly turned flange portions 65 of connecting element 34' to obstruct upward sliding movement of that element along the guide surfaces of link member 30'. To release the lock, a user simply pivots stop plate 31' outwardly (FIG. 10) allowing connecting element 34' to travel upwardly along the link member as illustrated in FIG. 11.

While in the foregoing I have disclosed embodiments of the invention in considerable detail for purposes of illustration, it will be understood by those skilled in the art that many of these details may be varied without departing from the spirit and scope of the invention.

I claim:

1. A link lock assembly for a folding table, said assembly including an elongated planar link member having a guide slot for guiding a connecting element during folding movement of a table to which said link member is adapted to be connected; said guide slot being L-shaped and including an elongated main leg portion extending longitudinally along said link member and a relatively short leg portion; and a stop plate overlying a portion of said link member along which said main leg portion of said guide slot extends and being mounted upon said link member for pivotal movement about an axis extending along the plane of said link member between a first position obstructing travel of a connecting element along said main leg portion of said guide slot and a second position displaced from said link member to permit such travel.

2. The assembly of claim 1 in which spring means are provided for urging said stop plate into said first position.

3. The assembly of claim 2 in which said stop plate is pivotally mounted upon said link member by a pair of mounting pins affixed to said link member and extending through said stop plate; aaid pins having enlarged heads for retaining said stop plate upon said link member.

4. The assembly of claim 3 in which said spring means includes a compression spring extending about at least one of said connecting pins and interposed between said stop plate and said head of said pin.

5. The assembly of claim 1 in which said stop plate includes an enlarged handle portion projecting beyond said link member.

6. The assembly of claim 1 in which said stop plate overlies at least a major portion of the main leg portion of said slot.

7. A folding table having a generally rectangular top and a support frame; a hinge connecting said top to said frame for pivotal movement of the top about a horizontal pivot line between a horizontal unfolded position and a generally vertical position; said pivot line being located beneath said top and spaced inwardly from opposite longitudinal edges thereof when said top is in its horizontal position; a let assembly pivotally connected to said top for bracing said top in its horizontal position and for permitting pivotal movement of the top in only one direction from said horizontal position; an elongated planar link member having an L-shaped guide slot with an elongated main leg portion extending longitudinally along said link member and a relatively short leg portion; said link member having one end pivotally joined to the hinge between said top and frame; and a connector secured to said leg assembly and slidably received in said guide slot for sliding movement of said connector along said main leg portion of said guide slot when said top is pivoted between its horizontal and vertical positions; wherein the improvement comprises a stop plate pivotally mounted upon said link member for movement about a pivot axis extending along the plane of said link member, said stop plate being pivotal between a first position wherein said plate blocks movement of said connector along said main leg portion of said guide slot of said link member when said top is in its horizontal position, and thereby prevents pivoting of said top into its vertical position, and a second position wherein said plate allows free travel of said connector along said guide slot.

8. The table of claim 7 in which spring means are provided for urging said stop plate into its first position.

9. The table of claim 8 in which said pivotal mounting of said stop plate includes mounting pins secured to said link member and extending through enlarged openings in said stop plate; said pins having enlarged head portions for retaining said stop member thereon.

10. The table of claim 9 which said spring means includes at least one compression spring carried by a mounting pin and disposed between said stop member and the head portion of said pin.

11. The table of claim 7 in which said stop plate has a handle portion extending beyond said link member for manually shifting said stop plate into its second position.

* * * * *